US010386782B2

(12) United States Patent
Kanno et al.

(10) Patent No.: US 10,386,782 B2
(45) Date of Patent: Aug. 20, 2019

(54) IMAGE FORMING APPARATUS

(71) Applicant: CANON KABUSHIKI KAISHA, Tokyo (JP)

(72) Inventors: Kazuhiko Kanno, Odawara (JP); Masanari Morioka, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/724,543

(22) Filed: Oct. 4, 2017

(65) Prior Publication Data

US 2018/0101124 A1 Apr. 12, 2018

(30) Foreign Application Priority Data

Oct. 7, 2016 (JP) ..... 2016-198670
Sep. 5, 2017 (JP) ..... 2017-169920

(51) Int. Cl.
*G03G 21/16* (2006.01)
*G03G 15/08* (2006.01)

(52) U.S. Cl.
CPC ..... *G03G 21/1647* (2013.01); *G03G 15/0867* (2013.01); *G03G 21/1671* (2013.01); *G03G 21/1676* (2013.01); *G03G 2221/1654* (2013.01)

(58) Field of Classification Search
CPC ..... G03G 21/1853; G03G 21/1623; G03G 2221/1684
See application file for complete search history.

(56) References Cited

U.S. PATENT DOCUMENTS 6,314,255 B1 11/2001 Yokomori et al.
7,555,235 B2 6/2009 Okabe et al.
7,907,868 B2 3/2011 Igarashi et al.
8,050,592 B2 11/2011 Igarashi et al.
8,311,451 B2 * 11/2012 Nishimura ..... G03G 21/1821 399/119
8,346,124 B2 1/2013 Igarashi et al.
8,761,636 B2 6/2014 Nishimura et al.
(Continued)

FOREIGN PATENT DOCUMENTS

JP 2007-072420 A 3/2007
JP 2007-121983 A 5/2007
(Continued)

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus includes a photosensitive member unit and a supporting member supporting a developer cartridge and movable between an inside position, wherein the supporting member is movable to the outside position independently from the photosensitive member unit. When the supporting member is in the inside position, the photosensitive member unit and the cartridge are disposed at positions overlapping with each other, and by the cartridge rotating about a coupling during the supporting member moving to the outside position, the cartridge is displaced from a first position taken when the supporting member is in the inside position to a second position in which the cartridge does not interfere with the photosensitive member unit when the supporting member is moved the outside position independently from the photosensitive member unit which remains inside the main assembly.

10 Claims, 12 Drawing Sheets

(56) References Cited

U.S. PATENT DOCUMENTS

| | | | | |
|---|---|---|---|---|
| 8,768,207 | B2 | 7/2014 | Igarashi et al. | |
| 8,953,979 | B2 | 2/2015 | Mori et al. | |
| 9,323,174 | B2 | 4/2016 | Kato | |
| 9,341,982 | B2 | 5/2016 | Nishimura et al. | |
| 9,442,456 | B2 | 9/2016 | Igarashi et al. | |
| 9,563,171 | B2 | 2/2017 | Nishimura et al. | |
| 2007/0160385 | A1* | 7/2007 | Noguchi ..... | G03G 21/1853 399/110 |
| 2012/0039624 | A1* | 2/2012 | Uchida ..... | G03G 21/1853 399/110 |
| 2015/0227110 | A1* | 8/2015 | Yoshimura ..... | G03G 21/1842 399/111 |

FOREIGN PATENT DOCUMENTS

| | | | |
|---|---|---|---|
| JP | 2010-026299 | A | 2/2010 |
| JP | 2012-145877 | A | 8/2012 |
| JP | 2013-050580 | A | 3/2013 |
| JP | 2014-145962 | A | 8/2014 |

* cited by examiner

IMAGE FORMING APPARATUS

FIELD OF THE INVENTION AND RELATED ART

The present invention relates to an image forming apparatus such as an electrophotographic copying machine and an electrophotographic printing machine (for example, laser beam printer, LED printer, etc.).

In the field of an electrophotographic image forming apparatus, there has been known the so-called cartridge system. According to this system, an image forming apparatus is structured so that a development cartridge, as a development unit, in which a developer storing portion, and a developing member such as a development roller, are integrally placed, is removably installed into the main assembly of the apparatus, and also, so that a process cartridge, as a processing unit, in which a photosensitive member, and processing members which process the photosensitive member, are integrally placed, is removably installed into the main assembly of the apparatus. That is, a cartridge system such as those employed by the image forming apparatuses described above can make it easier for a user of an image forming apparatus to maintain an electrophotographic image forming apparatus, since the developer, development roller, and/or photosensitive member, etc., in the image forming apparatus, which has reached the end of its life expectancy, can be easily replaced by replacing the cartridge which contains the expired developer, development roller, and/or photosensitive member, etc.

There is disclosed in Japanese Laid-open Patent Application No. 2007-121983, an image forming apparatus structured so that a development cartridge is removably installable in a drawer (supporting member) which is movable between its preset position in the main assembly of the apparatus, and its preset position outside the main assembly.

In recent years, it has become a common practice for an image forming apparatus to be used on a desk, a table, or the like. Thus, it has been desired to reduce the main assembly of an image forming apparatus in size. In the case of an image forming apparatus structured, as disclosed in Japanese Laid-open Patent Application No. 2007-121983, so that the main assembly of the apparatus is provided with a drawer, in which a cartridge is removably mountable, it is desired to reduce the main assembly in a space necessary for the movement of the drawer.

SUMMARY OF THE INVENTION

The present invention is made in consideration of the above-described current state of the field of image forming apparatus. Thus, the primary object of the present invention is to provide an image forming apparatus which is provided with a cartridge supporting member movable between its preset position in the main assembly of the apparatus and its preset position outside the main assembly, and which is structured so that cartridges are removably mountable in the drawer, and yet, is significantly smaller in the size of the main assembly than any conventional electrophotographic image forming apparatus.

According to an aspect of the present invention, there is provided an image forming apparatus for forming an image, said apparatus comprising a main assembly; a photosensitive member unit supported by said main assembly and including a photosensitive member; a cartridge including a coupling for receiving a driving force and an accommodating portion accommodating a developer to be supplied to the photosensitive member; and a supporting member provided inside said main assembly to support said cartridge and movable between an inside position in which said cartridge is mounted to said main assembly, and an outside position outside said main assembly, wherein when said supporting member is in the inside position, said photosensitive member unit and said cartridge are disposed at positions overlapping with each other as seen in a moving direction of said supporting member, and wherein by said cartridge rotating about a rotation axis of said coupling relative to said supporting member during said supporting member moving from the inside position to the outside position, said cartridge is displaced from a first position taken when said supporting member is in the inside position to a second position in which said cartridge does not interfere with said photosensitive member unit when said supporting member is moved from the inside position to the outside position.

Further features of the present invention will become apparent from the following description of exemplary embodiments with reference to the attached drawings.

Figure 11:
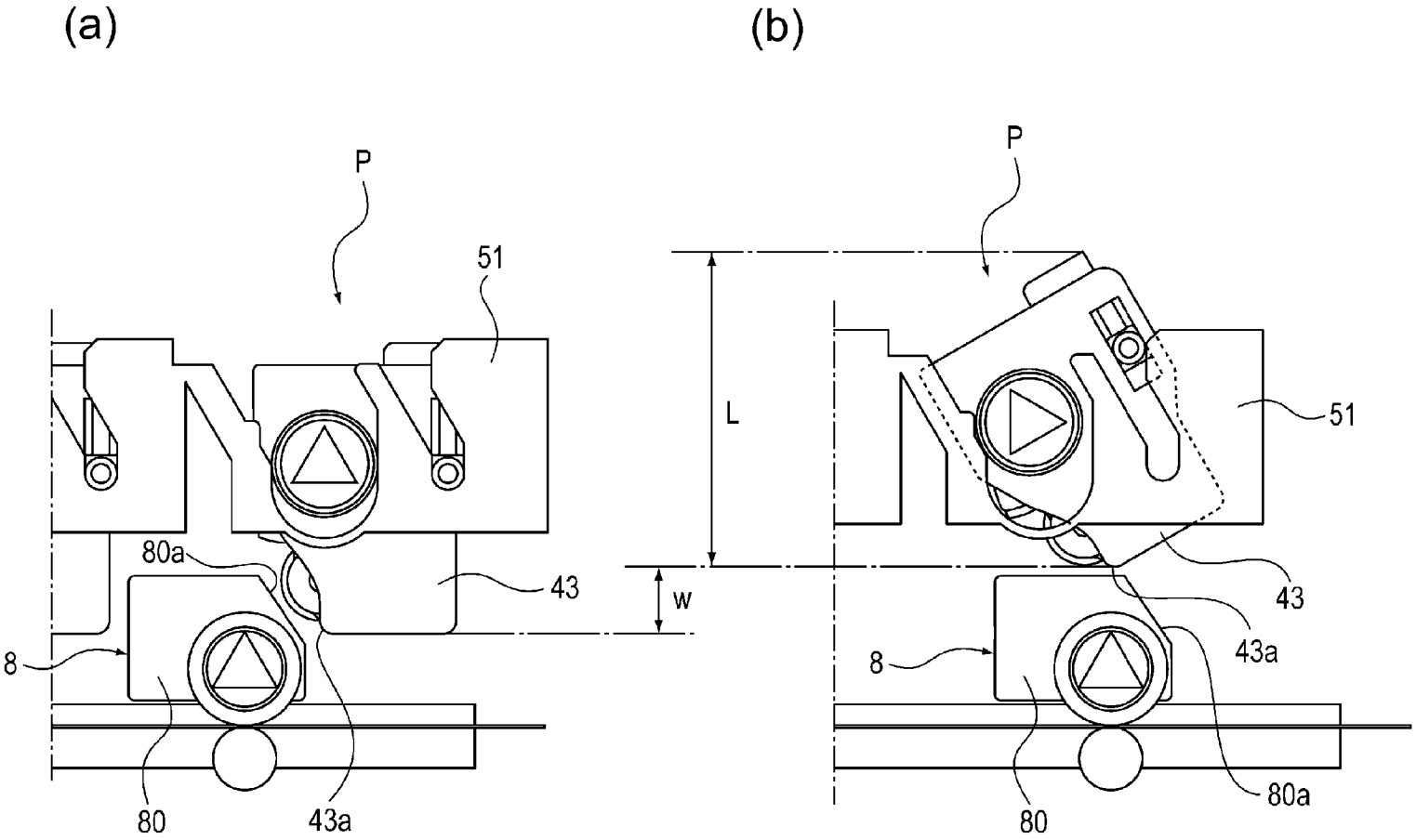

Part (a) of FIGS. 11 and 11(*b*) are enlarged side views of the development cartridge and its adjacencies, as seen from the side from which the cartridge is driven, when the development cartridge is upright and tilted, respectively.

Figure 12:
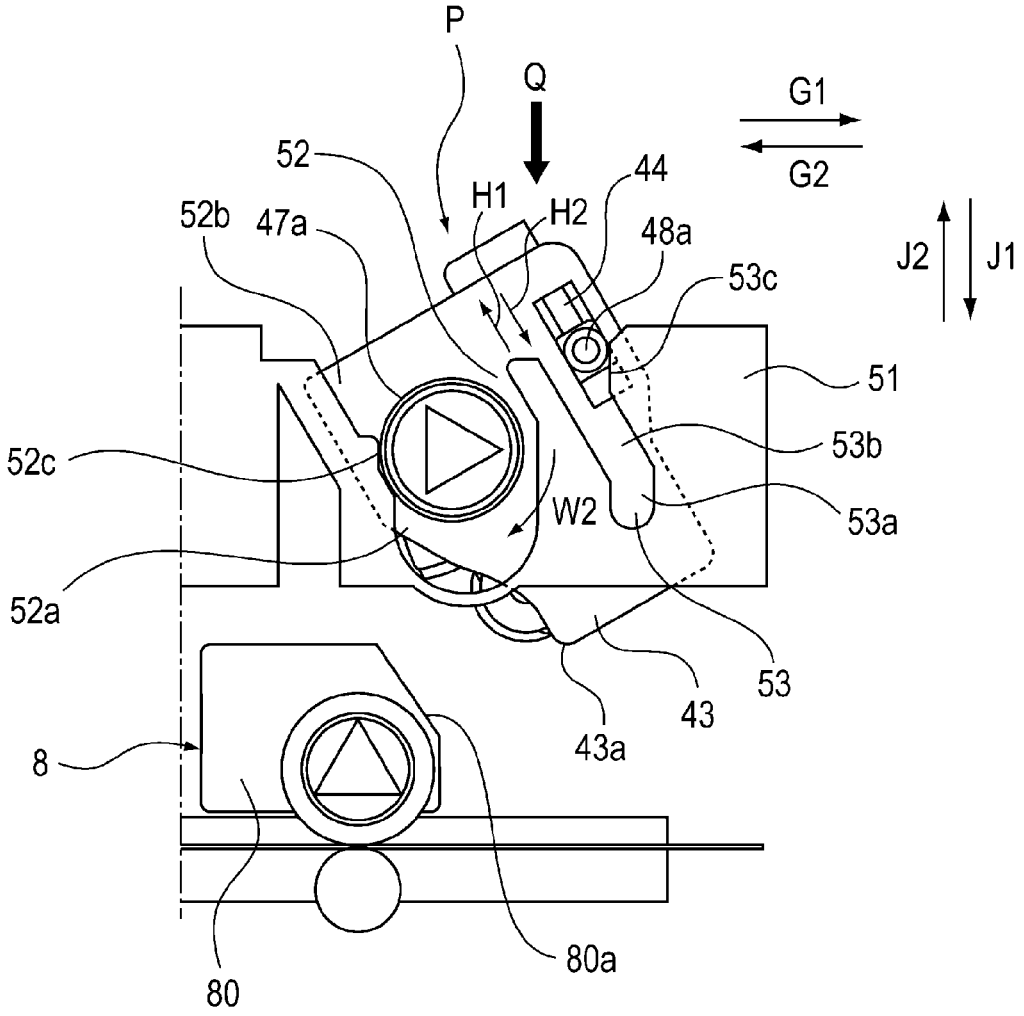

FIG. 12 is an enlarged side view of the development cartridge, as seen from the side from which the cartridge is driven, while the development cartridge is installed into the main assembly of the image forming apparatus.

DESCRIPTION OF THE EMBODIMENTS

Embodiment 1

<Image Forming Apparatus>

To begin with, with reference to the appended drawings, the image forming apparatus A in the first embodiment of the present invention is described about its overall structure, along with its image forming operation. The stated measurements, materials, shapes of the structural members of the image forming apparatus A, and their positional relationship, in this embodiment, are not intended to limit the present invention in scope, unless specifically noted.

The image forming apparatus A is an electrophotographic color image forming apparatus. It forms an image on recording medium with the use of four toners (developer) which are different in color, more specifically, yellow (Y), magenta (M), cyan (C) and black (K) toners, based on the information about the image to be formed, which is inputted into the control portion 100 of the image forming apparatus A from an external host apparatus 300. In this embodiment, a sheet S of ordinary paper, OHP film, etc., was used as the recording medium. As examples of the external host apparatus 300, a personal computer, an image reader, a facsimile, a network, etc., are thinkable.

Figure 1:
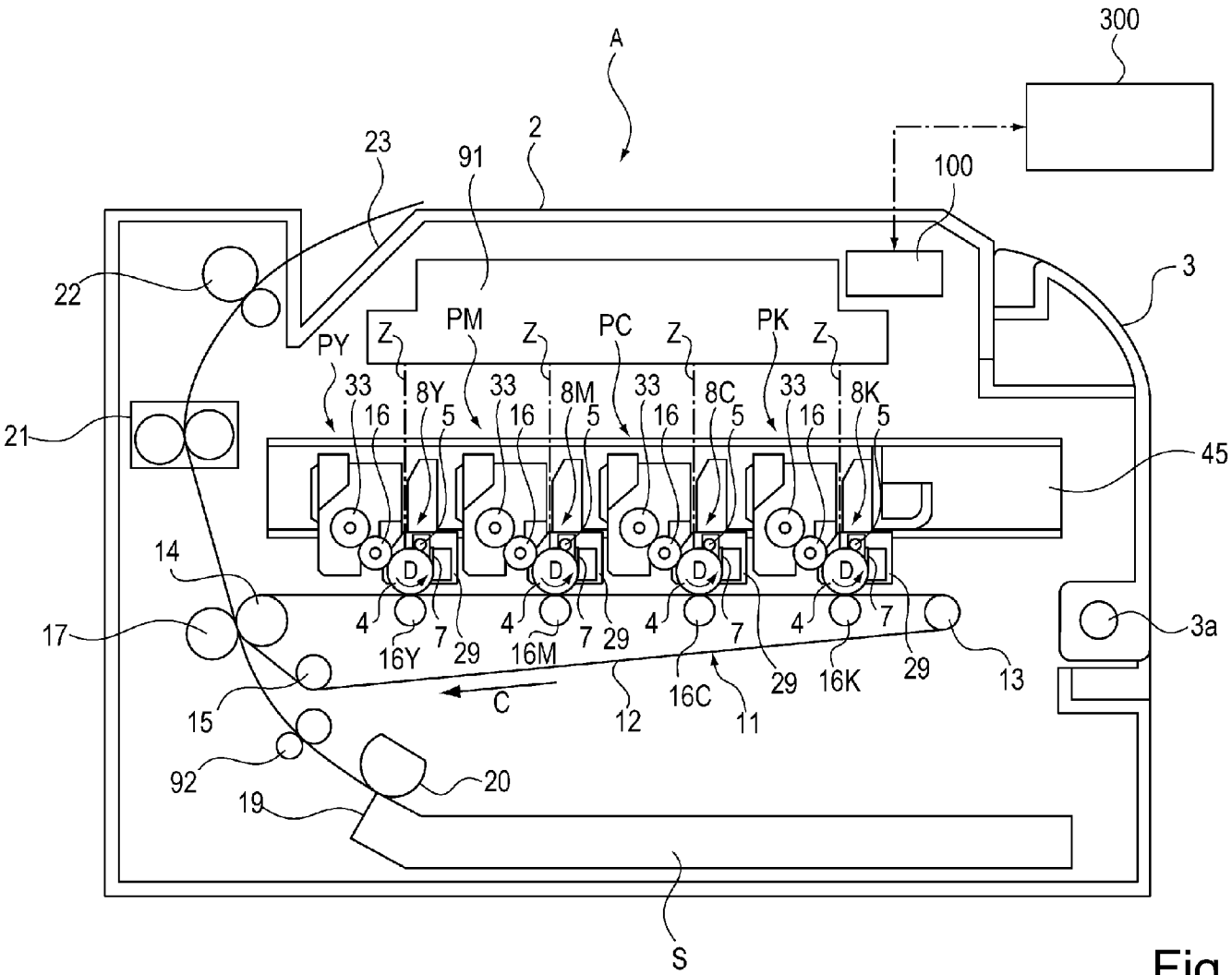
FIG. 1 is a schematic sectional view of a typical image forming apparatus to which the present invention is applicable.

Referring to FIG. 1, the image forming apparatus A has: an image forming portion which transfers a toner image onto a sheet S of recording medium; a sheet feeding-conveying portion which supplies the image forming apparatus with the sheet S, and a fixing portion which fixes the toner image to the sheet S.

The image forming portion has: photosensitive member units 8 (8Y, 8M, 8C and 8K), development cartridges P (PY, PM, PC and PK), an intermediary transfer unit 11, a laser scanner unit 91, etc.

The intermediary transfer unit 11 has primary transfer rollers 16 (16Y, 16M, 16C and 16K), an intermediary transfer belt 12, a secondary transfer roller 17, a belt-backing roller 14 (which opposes secondary transfer roller), a drive roller 13, a tension roller 15, etc. The intermediary transfer belt 12 is a flexible and endless belt. It is suspended and kept tensioned by the belt-backing roller 14, tension roller 15, and drive roller 13. As the drive roller 13 receives driving force from an unshown driving force source, the intermediary transfer belt 12 rotates in the direction indicated by an arrow mark C.

The photosensitive drum unit 8 has: a photosensitive drum 4 (image bearing member), which is an electrophotographic photosensitive member shaped like a drum; a charge roller 5; a cleaning blade 7; a cleaning means container 29; etc. By the way, the four photosensitive units 8 are the same in structure.

Figure 8:
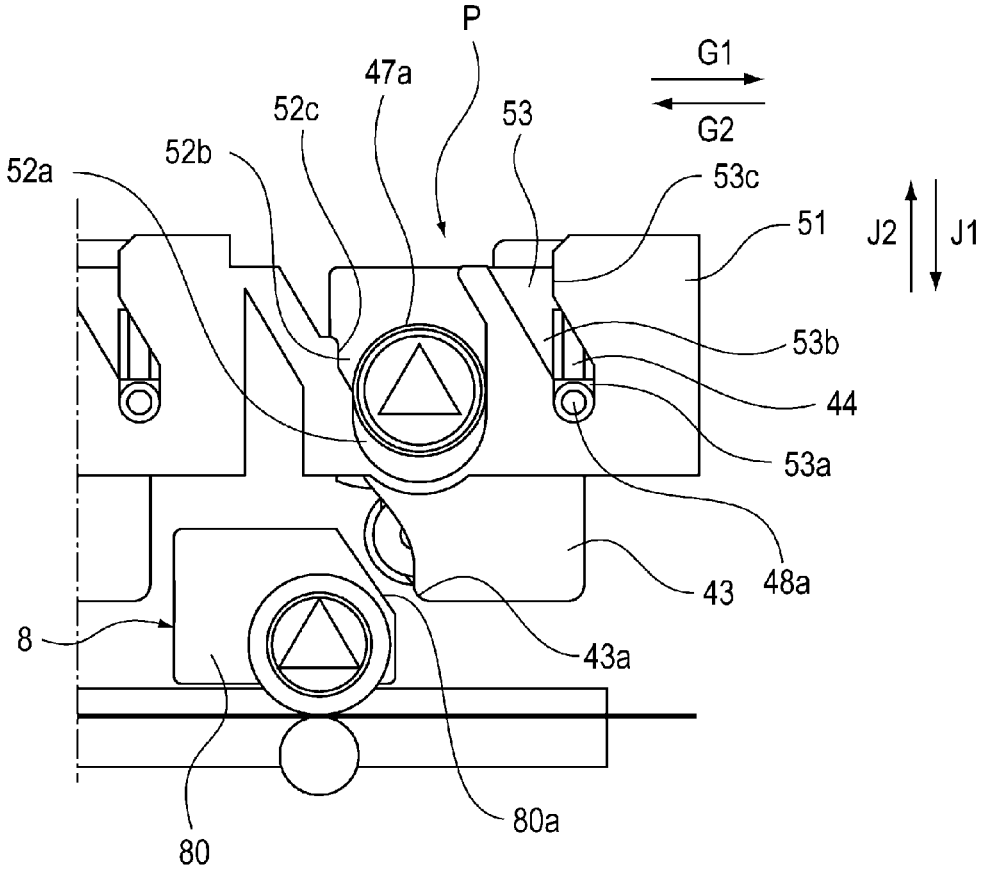
FIG. 8 is an enlarged side view of the development cartridge and its adjacencies, as seen from the side from which the cartridge is driven, while the development cartridge is removed from the main assembly of the image forming apparatus.

The photosensitive drum 4 is rotatably supported by a pair of bearing members (FIG. 8). As it receives a driving force from an unshown motor, it rotates in the direction indicated by an arrow mark D. The charge roller 5 is rotatably supported by the cleaning means container 29. It is in contact with the peripheral surface of the photosensitive drum 4, and is rotated by the rotation of the photosensitive drum 4. It charges the peripheral surface of the photosensitive drum 4 by being supplied with charge voltage (charge bias). The cleaning blade 7 is fixed to the cleaning means container 29. It is disposed in contact with the peripheral surface of the photosensitive drum 4 in such an attitude that its cleaning edge is on the upstream side of its base portion. Further, it is kept pressed upon the peripheral surface of the photosensitive drum 4 so that a preset amount of pressure is maintained between its cleaning edge and the peripheral surface of the photosensitive drum 4.

The development cartridge P is a developing apparatus of the contact type. It uses nonmagnetic single-component developer as toner. It has a development roller 6 (developer bearing member), which is rotatably supported. The development cartridge P remains pressed upon the photosensitive member unit 8 by the resiliency of unshown pressing members. Thus, the development roller 6 remains in contact with the photosensitive drum 4. Further, the development cartridge P has a toner storing portion 26*c* (FIG. 3), in which toner is stored. The four development cartridges P are the same in structure although they are different in the color of the toner they store in their toner storing portions 26*c*. The details of the structure of the development cartridge P are given later.

If the toner in the development cartridge P is entirely consumed by an image forming operation, a user can replace the empty development cartridge P to restart the interrupted image forming operation. More specifically, the main assembly of the image forming apparatus is provided with a development cartridge drawer 51 (which hereafter will be referred to simply as drawer 51), which can be pulled out of the main assembly in the frontward direction so that the development cartridge(s) can be mounted into, or removed from, the drawer 51 from the front side of the image forming apparatus.

Figure 2:
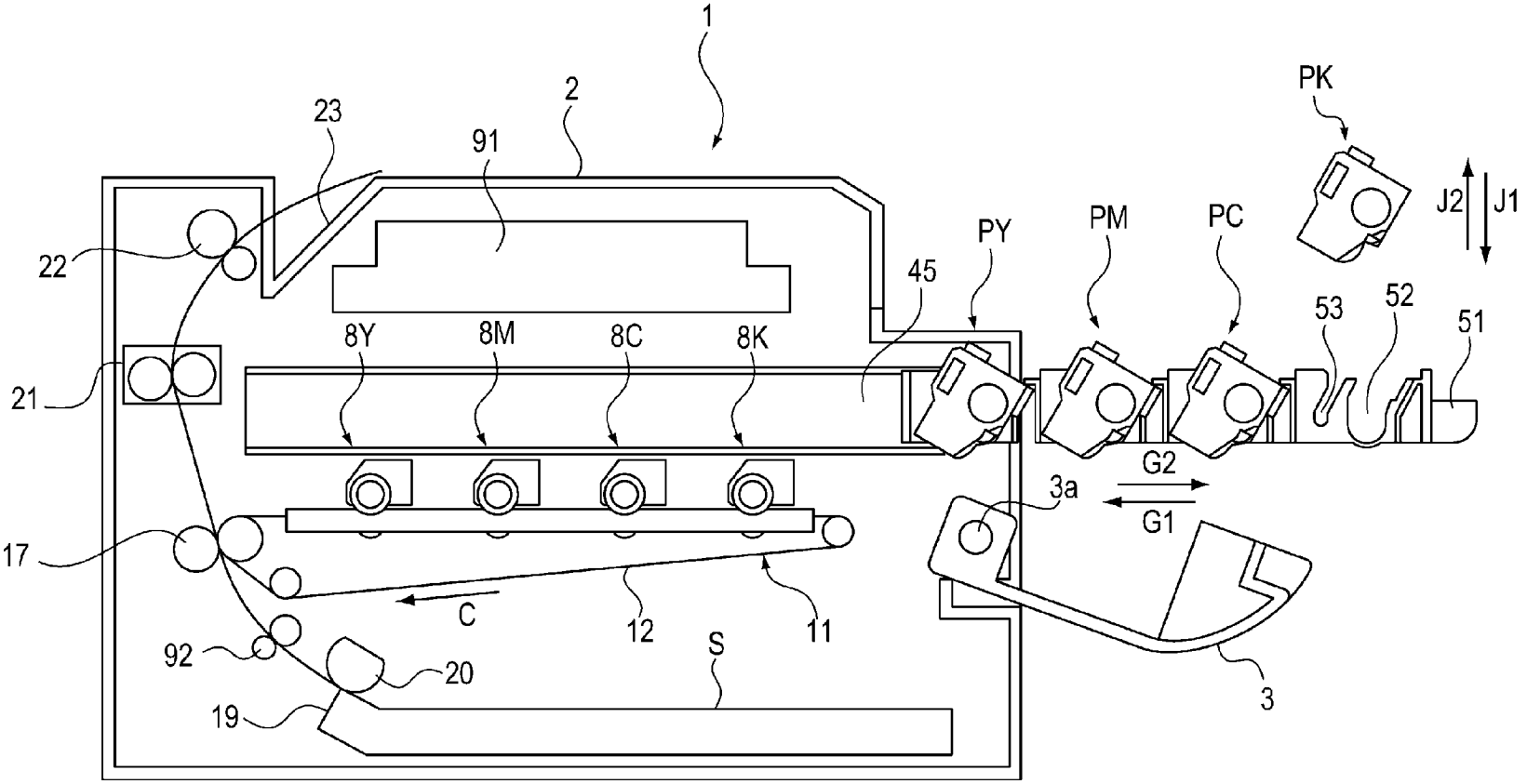
FIG. 2 is a schematic sectional view of the image forming apparatus, shown in FIG. 1, when the drawer of the apparatus is partially out of the main assembly.

FIG. 2 is a schematic sectional view of the image forming apparatus A in this embodiment, when the drawer 51 is partially out of the main assembly of the image forming apparatus. Referring to FIG. 2, the main assembly 2 of the image forming apparatus is provided with a door (member that can be opened or closed). The image forming apparatus A is structured so that as the door 3 is opened, an opening, with which the main assembly 3 is provided, is exposed so that the drawer 51 can be linearly moved into, or out of, the main assembly in the directions indicated by arrow marks G1 or G2, respectively, along a pair of rails 45, with which the main assembly 2 is provided. That is, the image forming apparatus A is structured so that the drawer 51 is movable between its preset inside position (in apparatus main assembly 2) which keeps the cartridges P in the drawer 51 in their preset positions in the main assembly 2, and its preset outside position (outside apparatus main assembly 2) which allows the cartridge(s) P to be mounted into, or removed from, the drawer 51, in the directions indicated by arrow marks J1 and J2, respectively. Further, the drawer 51 is structured so that the cartridges P are disposed in parallel to each other, with the axial line of each photosensitive drum 4 being perpendicular to the moving direction of the drawer 51.

In the following description of the embodiment of the present invention, the directions (indicated by arrow marks G2 and G1) in which the drawer 51 is pulled out of, or pushed into, the main assembly 3 are referred to as "pull-out direction, or push-in direction", respectively, which are practically horizontal.

Next, the image forming operation of the image forming apparatus A is described. Referring to FIG. 1, first, the control portion 100 of the image forming apparatus A outputs an image formation start signal. As the image formation start signal is outputted, sheets S of recording medium stored in layers in a sheet storing portion 19 are sent one by one to the image forming portion by a pickup roller 20.

Meanwhile, in the image forming portion, the peripheral surface of the photosensitive drum 4 is charged by the charge roller 5. Then, the laser scanner 91 projects a beam Z of laser light from its unshown internal light source while modulating the beam Z according to the information of the aforementioned four monochromatic images, into which the image to be formed was separated. Consequently, an electrostatic latent image which reflects the information of one of the monochromatic images, is effected on the peripheral surface of the photosensitive drum 4. Then, development voltage (development bias) is applied to the development roller 6. Thus, toner is adhered to the electrostatic latent image on the peripheral surface of the photosensitive drum 4, yielding a toner image, that is, a visible image formed of the toner.

The toner images formed on photosensitive drums 4 one for one are transferred (primary transfer) onto the intermediary transfer belt 12 by the voltage (transfer bias) applied to the primary transfer rollers 16. As a result, a full-color toner image is synthetically formed of yellow, magenta, cyan, and black toner images, on the intermediary transfer belt 12.

After the primary transfer of the toner images onto the intermediary transfer belt 12, the toner images on the intermediary transfer belt 12 are conveyed by the rotation of the intermediary transfer belt 12 in the direction indicated by an arrow mark C, to the secondary transferring portion formed by the primary transfer roller 17 and belt-backing roller 14, on the downstream side of the image forming portion in terms of the moving direction of the intermediary transfer belt 12. Meanwhile, the sheet S is introduced into the secondary transferring portion by the pair of registration rollers 92 with preset control timing. Thus, the toner images on the intermediary transfer belt 12 are transferred onto the sheet S.

After the transfer of the toner images onto the sheet S, the sheet S is introduced into the fixing apparatus 21, in which the sheet S and toner images thereon are heated and pressed by the fixation nip of the fixing apparatus 21. Consequently, the toner in the toner images are fixed to the sheet S. Thereafter, the sheet S is conveyed out of the fixing apparatus 21, and then, is discharged as a full-color print, into a delivery tray 23 by a pair of discharge rollers 22. This is how an image is formed on the sheet S through the image forming operation of the image forming apparatus A in this embodiment.

By the way, the toner remaining on the peripheral surface of the photosensitive drum 4 after the transfer of the toner images onto the intermediary transfer belt 12 is removed by a cleaning blade 7, and is stored in an unshown storage for recovered toner, which is in the container 29 for cleaning means.

<Development Cartridge>

Next, the structure of the development cartridge P is described. As described previously, the four development cartridges P are the same in structure, although they are different in the color of the toner they store. By the way, in the following description of this embodiment, the side of the apparatus main assembly 2, which has the door 3, is referred to as the front side, and the opposite side of the apparatus main assembly 2 from the front side is referred to as the rear side. Further, the right and left sides of the apparatus main assembly 2 as seen from the front side is referred to as the driving side and non-driving side, respectively.

Figure 3:
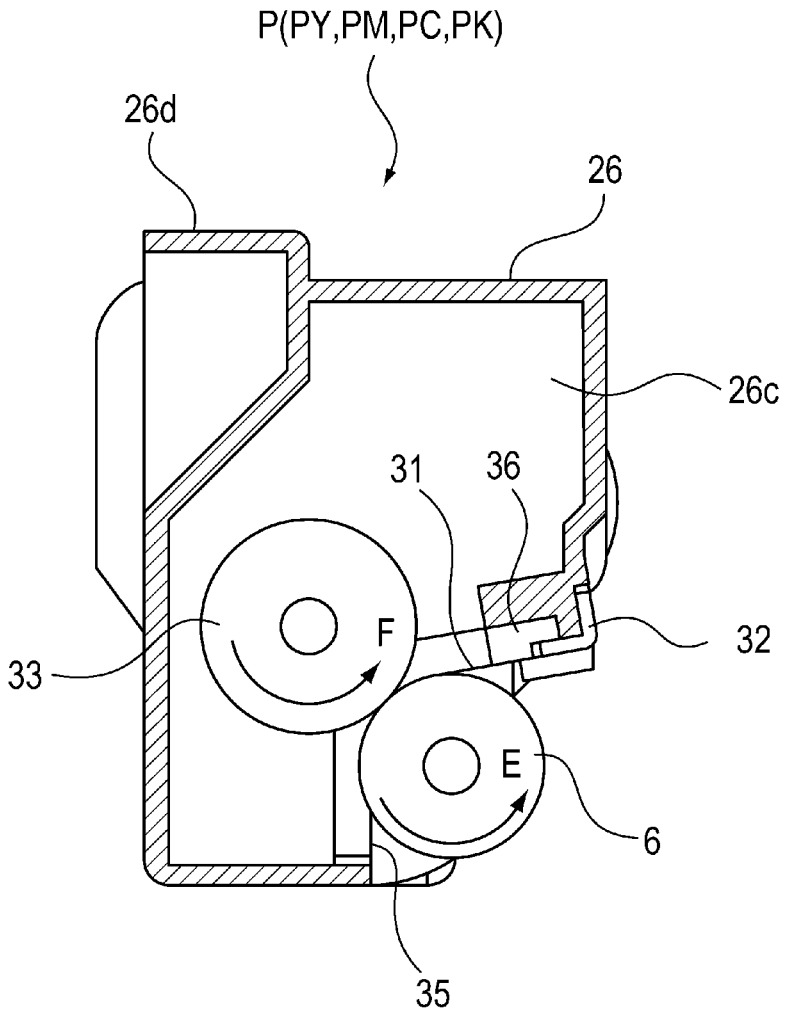
FIG. 3 is a schematic sectional view of the development cartridge for the image forming apparatus shown in FIG. 1.
Figure 4:
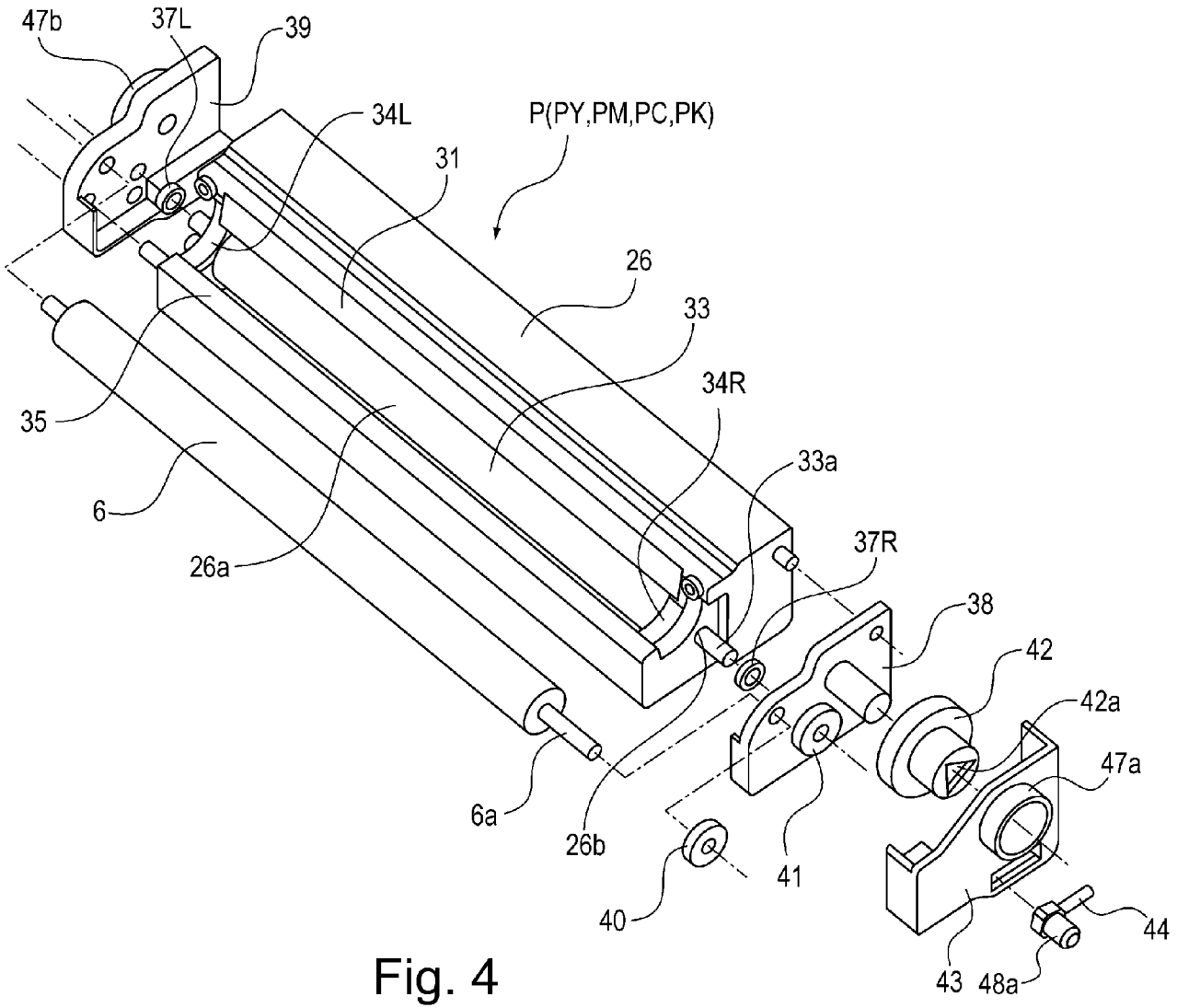
FIG. 4 is an exploded perspective view of the development cartridge shown in FIG. 3.

FIG. 3 is a schematic sectional view of the development cartridge P, and FIG. 4 is an exploded perspective view of the development cartridge P. As is evident from FIGS. 3 and 4, the development cartridge P is long and narrow. Its lengthwise direction is parallel to the rotational axis of the development roller 6. The development cartridge P has a toner storage portion 26*c* (storing portion), a frame 26, a development blade 31, a developer supply roller 33, end seals 34 (34R and 34L), a flexible sheet 35, a pair of seals 37 (37R and 37L) for the developer supply roller 33, etc.

The development roller 6 is disposed at the opening 26*a* of the development cartridge frame 26. It is rotatably supported by the cartridge frame 26. More specifically, the lengthwise ends of the metallic core 6*a* of the development roller 6, which functions as the axle of the development roller 6, are rotatably supported by a pair of bearings 38 (driving side) and 39 (non-driving side) attached to the front and rear walls of the frame 26, respectively. Further, one of the lengthwise ends of the metallic core 6*a* is fitted with a development roller gear 40, which is in mesh with a driving force input gear 42.

The developer supply roller 33 is disposed at the opening 26*a* of the frame 26 of the development cartridge P. It is rotatably supported by the frame 26. More specifically, the lengthwise end portions of the metallic core 33*a* (which functions as the axle of the developer supply roller 33) of the developer supply roller 33 are rotatably supported by a pair of bearings 38 (driving side) and 39 (non-driving side) attached to the front and rear walls of the frame 26, one for one. The driving side end of the metallic core 33*a* is fitted with a developer supply roller gear 41, which is in mesh with the driving force input gear 42 for the development roller 6.

The driving force input gear 42 for the development roller 6 has a coupling 42*a*, with which the driving force output coupling (unshown) of the apparatus main assembly 2 engages to transmit the driving force from a motor (unshown) of the apparatus main assembly 2, to the driving force input gear 42 (driving force is inputted). As the driving force is transmitted, the development roller 6 and developer supply roller 33 are rotationally driven in the directions indicated by arrow marks E and F in FIG. 3, at preset speeds.

The development roller gear 40, developer supply roller 41, and driving force input gear 42 are covered with a side cover 43, which is on the driving side. The side cover 43 rotatably supports the driving force input gear 42 for development roller 6.

The development blade 31 is a piece of thin and elastic metallic plate, which is roughly 0.1 mm in thickness. It is in the form of a long and narrow rectangle. It is supported by the frame 26 of the development cartridge P; a blade supporting metallic plate 32 is attached the frame 26. The development blade 31 is attached to the frame 26 in such an attitude that its free edge (regulating edge) contacts the peripheral surface of the development roller 6, and also, that the regulating edge is on an upstream side of the base portion of the development blade 31, in terms of the rotational direction of the development roller 6. Further, between the development blade 31 and blade supporting metallic plate 32, a development blade bottom seal 36 for preventing toner leakage is disposed.

During an image forming operation, the developer supply roller 33 and development roller 6 are rotationally driven in a manner to rub each other. Thus, the toner in the toner storage portion 26*c* is borne on the peripheral surface of the development roller 6. The development blade 31 regulates in thickness the toner layer on the peripheral surface of the development roller 6, and also, gives the toner a triboelectric charge, in the area of contact between itself and development roller 6 by being pressed against the peripheral surface of the development roller 6 with the presence of the toner layer between itself and the peripheral surface of the development roller 6. Thus, the charged toner on the development roller 6 adheres to the peripheral surface of the photosensitive drum 4 in the pattern of the electrostatic latent image on the photosensitive drum 4, in the area of contact between the development roller 6 and photosensitive drum 4. That is, the latent image is developed.

The lengthwise end portions of the opening 26*a* of the frame 26 of the development cartridge P are provided with a pair of end seals 34R and 34L, one for one, to prevent toner from leaking out of the development cartridge P through the gaps between development blade 31 and the frame 26, and between the development roller 6 and frame 26.

Further, the development cartridge P is provided with a piece of flexible sheet 35, which is attached to one of the lengthwise edges of the opening 26*a* of the frame 26, which opposes the development blade 31, so that it extends in the lengthwise direction of the development blade 31, in contact with development roller 6. The flexible sheet 35 prevents toner from leaking from the development cartridge P through the gaps between the frame 26 of the development cartridge P, and the development roller 6.

Further, the lengthwise end portions of the metallic core 33*a* of the developer supply roller 33 are outwardly exposed from the frame 26 of the development cartridge P. These portions of the metallic core 33*a* are fitted with a pair of seals 37R and 37L for the toner supply roller shaft, one for one, which are for preventing toner leakage from the development cartridge P through the gaps between the wall of the holes 26*b* with which the frame 26 is provided to allow the metallic core 33*a* to put through the frame 26, and the metallic core 33*a*.

Figure 5:
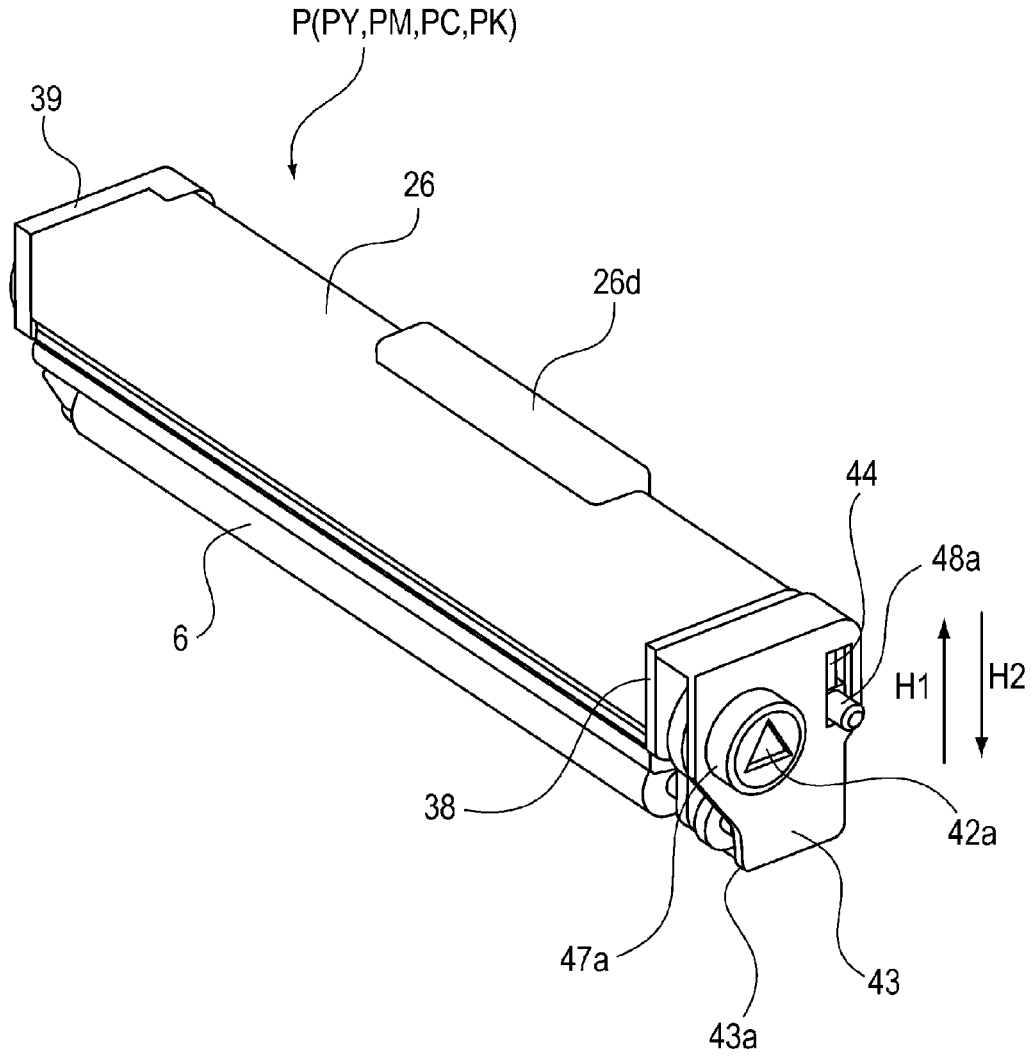
FIG. 5 is an external perspective view of the development cartridge, shown in FIG. 3, as seen from the side from which it is driven.
Figure 6:
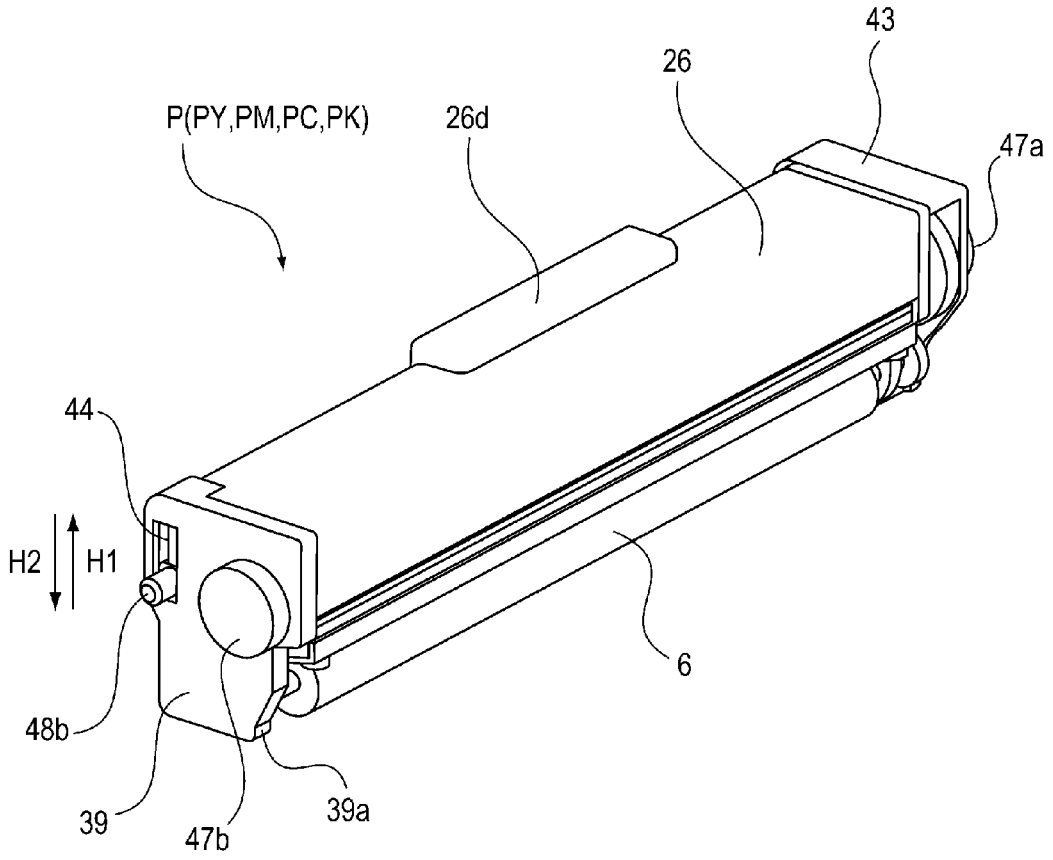
FIG. 6 is an external perspective view of the development cartridge, shown in FIG. 3, as seen from the opposite side from the side from which the development cartridge is driven.

FIG. 5 is an external perspective view of the development cartridge P as seen from the driving side. FIG. 6 is an external perspective view of the development cartridge P as seen from the non-driving side. As is evident from FIGS. 5 and 6, the development cartridge P has: a pair of center shafts 47 (47*a* and 47*b*) which engage with the drawer 51; and a pair of rotation stoppers 48 (48*a* and 48*b*). More specifically, it is the lengthwise end walls of the frame 26 that are provided with the pair of center shafts 47 and pair of rotation stoppers 48, one for one. Further, the development cartridge P is provided with a handhold 26*d* for a user to hold the development cartridge P. The handhold 26*d* is an integral part of the frame 26.

More concretely, the center shaft 47*a* is on the driving side. It is an integral part of the side cover 43. The rotation stopper 48*a* is supported so that it is allowed to move in the directions indicated by arrow marks H1 and H2. It is under the pressure generated by a pressure application spring 44 in the direction indicated by the arrow mark H2. The driving force transmission coupling 42*a* is coaxially disposed with the center shaft 47*a*. Referring to FIG. 4, the center shaft 47*a* is in the form of a cylindrical rib, and its axial line coincides with that of the coupling 42*a*. It is disposed so that it fits around the coupling 42*a*.

The center shaft 47*b* and bearing 39 are integral parts of the lengthwise end wall of the development cartridge P, on the non-driving side. The rotation stopper 48*b* is supported so that it is allowed to move in the directions indicated by the arrow marks H1 and H2. It is under the pressure generated by a pressure application spring 44 in the direction indicated by the arrow mark H2.

<Supporting Member>

Next, the drawer 51, as a supporting member, is described about its structure.

Figure 7:
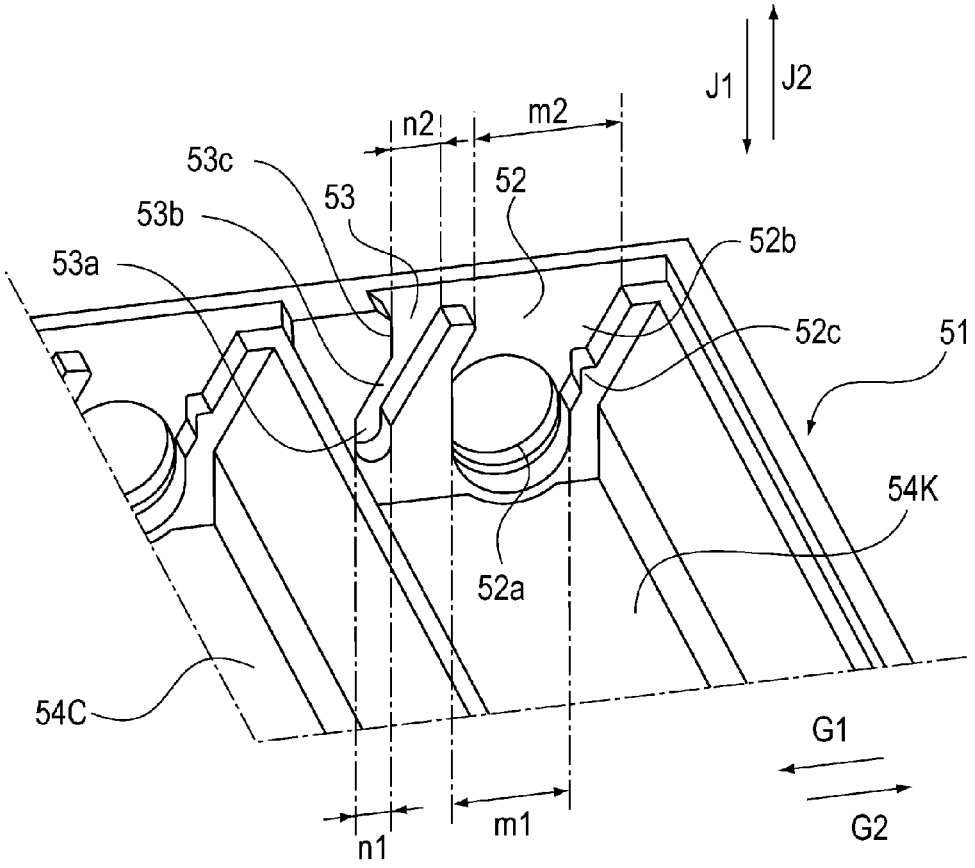
FIG. 7 is a schematic perspective view of a part of the development cartridge drawer.

FIG. 7 is a schematic perspective view of one of the lengthwise end portions of the cartridge bay 54K of the drawer 51, and a part of the corresponding lengthwise end of the cartridge bay 54C. Referring to FIG. 7, the drawer 51 is provided with four cartridge bays 54 (54Y, 54M, 54C and 54K) for the development cartridge P. It is designed so that the four cartridge bays 54 align in parallel in the direction parallel to the direction in which the drawer is moved out, or into, the apparatus main assembly 2. By the way, the four cartridge bays 54 are the same in structure. Thus, it is only the cartridge bays 45C and 45K that are shown in FIG. 7. Further, the driving side of each cartridge bay 54 is symmetrical to the non-driving side of the same cartridge bay 54. In the following description of the supporting member, only the driving side structure of the cartridge bay 54K is described.

Both lengthwise ends of the cartridge bay 54K have: the first engagement grooves 52, into which the center shafts 47*a* of the development cartridge PK fits; and the second groove 53, into which the rotation stopper 48*a* of the development cartridge PK fits.

The first groove 52 has a vertical portion 52*a* which allows the development cartridge PK to move only in the vertical direction (up or down indicated by arrow marks J2 and J1, respectively) when the center shaft 47*a* is in the first groove 52. It has also slanted portion 52*b* which is tilted in the direction (indicated by arrow mark G2) in which the drawer 51 is pulled outward of the apparatus main assembly 2. The slanted portion 52*b* is on the upstream side of the vertical portion 52*a* in terms of the direction (indicated by arrow mark J1) in which the development cartridge PK is inserted into the apparatus main assembly 2. The width m2 of the slanted portion 52*b* is greater than the width m1 of the vertical portion 52*a*. Further, the first groove 52 has a vertical surface 52*c*, which extends upward from a part of one of the lateral surfaces of the slanted portion 52*b*.

The second groove 53 has a vertical portion 53*a* which allows the development cartridge PK to move only in the vertical (up or down direction indicated by arrow marks J2 and J1, respectively) when the rotation stopper 48*a* is in the second groove 53. Further, it has a slanted portion 53*b* which is tilted in the direction (indicated by arrow mark G2) in which the drawer is pulled out of the apparatus main assembly 2. The slanted portion 53*b* is on the upstream side of the vertical portion 52*a* in terms of the direction (indicated by arrow mark J1) in which the development cartridge PK is inserted into the apparatus main assembly 2. Moreover, the second groove 53 has a vertical surface 53*c*, which extends upward from a part of one of the lateral surfaces of the slanted portion 53*b*.

As the drawer 51 is moved into its preset inside position in the apparatus main assembly 2 while it is holding the development cartridge PK, the center shaft 47*a* and rotation stopper 48*a* of the development cartridge P are made to fit in the vertical portion 52*a* of the first groove 52, and the vertical portion 53*a* of the second groove 53, respectively, by the pressure applied by an unshown pressing member, with which the apparatus main assembly 2 is provided. That is, the development cartridge P is positioned relative to the drawer 51 by a combination of the center shafts 47 and rotation stopper 48, being thereby allowed to move only in the vertical direction. In other words, the center shafts 47 is such a positioning portion that positions the development cartridge P relative to the drawer 51.

<Installation of Cartridge into Apparatus Main Assembly, and Uninstallation of Cartridge from Apparatus Main Assembly>

Next, the installation of the development cartridge P into the apparatus main assembly 2, and the uninstallation of the development cartridge P from the apparatus main assembly 2, are described.

To begin with, the operation to uninstall the development cartridge P from the apparatus main assembly 2 is described. By the way, what occurs on the driving side of the image forming apparatus A, and that on the non-driving side, are the same. Thus, only what occurs on the driving side is described. The four development cartridges P are the same in the operation through which they are installed into, or uninstalled from, the apparatus main assembly 2. Thus, only the operation through which one of the development cartridges P is installed or uninstalled is described.

First, the operation for uninstalling the development cartridge P in the apparatus main assembly 2 (FIG. 1) is described. The first step of the operation is to rotationally move the door 3 (FIGS. 1 and 2) about a shaft 3*a* (hinge) to open the door 3. As the door 3 is opened, the driving force receiving coupling 42*a* of the development cartridge P is disengaged from the driving force transmitting portion of the apparatus main assembly 2, and the voltage receiving portions of the development cartridge P are disconnected from the voltage (various biases) applying portions of the apparatus main assembly 2. Further, the pressing member is separated from the development cartridge P by the rotational movement of the door 3. Moreover, the rails 45 are moved vertically upward (direction indicated by arrow mark J2) by the movement of the door 3, causing thereby the development roller 6 to separate from the photosensitive drum 4.

FIG. 8 is an enlarged side view of the development cartridge P when the door 3 is fully open. Referring to FIG. 8, when the door 3 is fully open, the center shaft 47*a* of the development cartridge P is in the vertical portions 52*a* and 53*a* of the first and second grooves 52 and 53, respectively, of the drawer 51. Thus, the development cartridge P is allowed to move only in the direction indicated by the arrow mark J1 or J2. Further, when the drawer 51 is in its image formation position (inside position) in the apparatus main assembly 2, the development cartridge P and photosensitive member unit 8 overlap with each other as seen from the moving direction of the drawer 51. By structuring the image forming apparatus A in this manner, it is possible to make the apparatus main assembly 2 compact.

Figure 9:
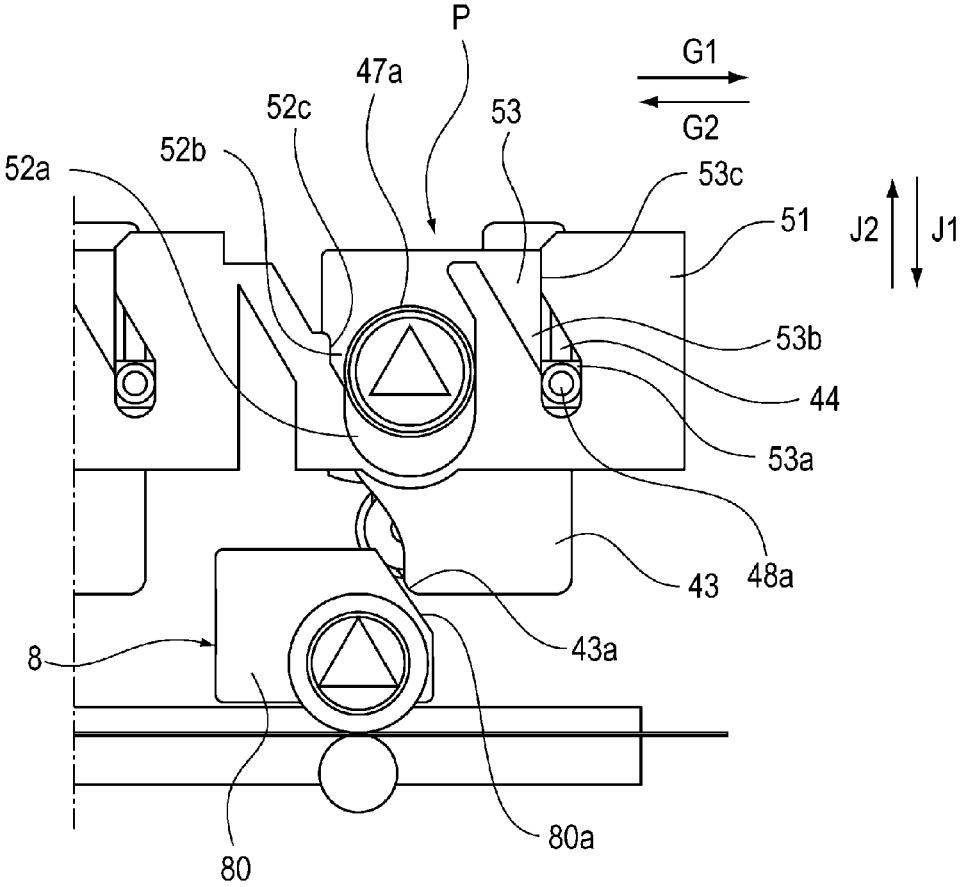
FIG. 9 is an enlarged side view of the development cartridge and its adjacencies, as seen from the side from which the cartridge is driven, while the development cartridge is removed from the main assembly of the image forming apparatus.

FIG. 9 is an enlarged side view of the development cartridge P after the drawer 51 was moved outward (indicated by arrow mark G2) of the apparatus main assembly 2 from the position shown in FIG. 8. Referring to FIG. 9, as the drawer 51 is moved outward of the apparatus main assembly 2, the cartridge guiding surface 80*a* of the bearing member 80 of the photosensitive member unit 8 comes into contact with the bottom left corner 43*a* (by which development cartridge P is guided) of the development cartridge P.

Then, as the drawer 51 is moved further outward, the bottom left corner 43*a* of the development cartridge P is pushed upward by the guiding surface 80*a*, causing thereby the development cartridge P to be vertically upward along the vertical portions 52*a* and 53*a* of the first and second grooves 52 and 53, respectively. This vertically upward movement of the development cartridge P causes the center shaft 47*a* and rotation stopper 48*a* to come out of the vertical portion 52*a* of the first groove 52, and the vertical portion 53*a* of the second groove 53, respectively, allowing thereby the center shaft 47*a* and rotation stopper 48*a* to move along the slanted portions 52*b* and 53*b* of the first and second grooves 52 and 53, respectively.

Then, as the drawer 51 is moved further outward, the guiding surface 80 causes the bottom left corner 43*a* to move further upward along the surface 80. Thus, the development cartridge P begins to move diagonally upward along the slanted portions 52*b* and 53*b* of the first and second grooves 52 and 53, respectively.

Figure 10:
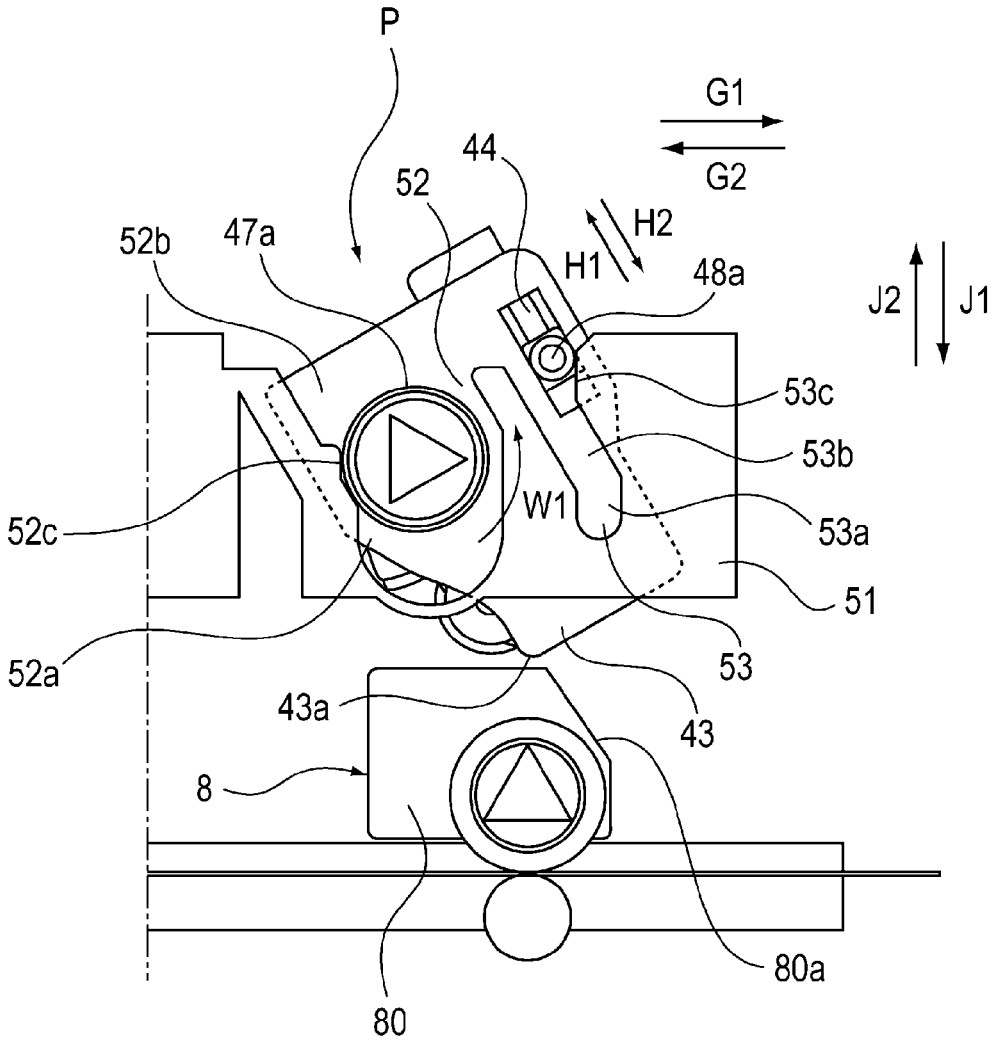
FIG. 10 is an enlarged side view of the development cartridge and its adjacencies, as seen from the side from which the cartridge is driven, while the development cartridge is removed from the main assembly of the image forming apparatus.

FIG. 10 is an enlarged side view of the development cartridge P and its adjacencies after the drawer 51 was moved further outward (indicated by arrow mark G2) of the apparatus main assembly 2 from the position shown in FIG. 9. Referring to FIG. 10, as the drawer 51 is moved further outward, the center shaft 47*a* comes into contact with the vertical surface 52*c*, which extends vertically upward from a part of one of the lateral walls of the slanted portion 52*b* of the first groove 52.

As the drawer 51 is moved further outward from the position shown in FIG. 10, the development cartridge P is made to rotate in the direction indicated by an arrow mark W1 about the center shaft 47*a*. While the development cartridge P is rotated, the center shaft 47*a* remains in contact with both the slanted portion 52*b* of the first groove 52, and the vertical surface 52*c*. Thus, the rotational axis of the center shaft 47 does not change in position. That is, the combination of the slanted portion 5*b* of the first groove 52 and the vertical portion 52*c* of the first groove 52 functions as a portion (at-rotation positioning portion) to which that center shaft 47 comes into contact to position the rotational axis of the development cartridge P. By the way, the rotational axis of the development cartridge driving coupling 42 coincides with the rotational axis of the center shaft 47*a* as described above. Therefore, that the development cartridge P rotates in the direction indicated by the arrow mark W1 about the center shaft 47*a* means the same as that the development cartridge P rotates in the direction indicated by the arrow mark W1 about the rotational axis of the development cartridge driving coupling 42. As the development cartridge P is rotated as described above, the development cartridge P changes in the attitude relative to the drawer 51 from the vertical one (first attitude), in which it was right after its insertion into the drawer 51, into the slanted one (second attitude), in which it does not collide with the photosensitive member unit 8 when the drawer 51 is moved. More concretely, as the drawer 51 is moved further outward, the development cartridge P is tilted in such a manner that its top end portion shifts in the direction in which the drawer 51 is being moved. That is, the development cartridge P is changed in attitude so that it does not overlap with the photosensitive member unit 8 in terms of the direction in which the drawer 51 is pulled out of the apparatus main assembly 2. That is, the guiding surface 80*a* is a part of the apparatus main assembly 2, and functions as such a guide that as the development cartridge P comes into contact with the guiding surface 80*a*, the guiding surface 80*a* changes the development cartridge P in attitude from the vertical one into the slanted one.

Further, while the bottom left portion 43*a* of the development cartridge P is moved upward along the guiding surface 80*a*, the rotation stopper 48*a* is moved in the direction indicated by the arrow mark H1 by the weight of the development cartridge P itself, whereby the pressure application spring 44 is compressed. Thus, the rotation stopper 48*a* remains pressed by the spring 44 in the direction indicated by the arrow mark H2.

Then, as the drawer 51 is moved further outward to a position at which the bottom left end portion 43*a* of the development cartridge P separates from the guiding surface 80*a*, the rotation stopper 48*a* comes out of the slanted portion 53*b* of the second groove 53, and immediately comes into contact with the vertical surface 53*c* of the second groove 53. At this point in time, the pressure generated by the pressure application spring 44 to press the rotation stopper 48*a* in the direction indicated by the arrow mark H2 functions as a force to suspend the process cartridge P between the vertical surfaces 52*c* and 53*c*. Thus, the development cartridge P remains tilted. By the way, the amount of force to be generated by the pressure application spring 44, and the length of the spring 44, are set so that the amount of force generated by the spring 44 in the direction indicated by the arrow mark H2 is large enough to keep the development cartridge P tilted. As described above, the development cartridge P rotates in the direction indicated by the arrow mark W1 about the rotational axis of the development cartridge driving coupling 42. Thus, the image forming apparatus A in this embodiment is smaller in the amount of force necessary to rotate the development cartridge P. Generally speaking, the development cartridge P is designed so that the rotational axis of the development cartridge driving coupling 42 is in the adjacencies of the center of gravity of the development cartridge P. Thus, by designing the development cartridge P so that the rotational axis of the development cartridge P coincides with the rotational axis of the development cartridge driving coupling 42, it is possible to place the rotational axis of the development cartridge P in the adjacencies of the center of gravity of the development cartridge P to minimize the amount of the moment necessary to rotate the development cartridge P.

Further, in this embodiment, the development cartridge P is designed so that the center shaft 47*a*, which is positioned by the vertical portion 52*a* of the first groove 52, functions also as the rotational axis of the development cartridge P. Therefore, the development cartridge P in this embodiment is substantially smaller in size than a development cartridge designed so that the center shaft 47*a* of the development cartridge P does not coincide with the rotational axis of the development cartridge P.

Thereafter, the drawer 51 is moved further outward of the apparatus main assembly 2 until it reaches its preset outermost position (outside position), in which the development cartridge P can be removed out of the drawer 51 to be replaced. By the way, while the drawer 51 is moved to its outside position, the development cartridge P remains tilted. Therefore, it does not occur that the development cartridge P comes into contact with the photosensitive member unit 8 while the drawer 51 is moved outward of the apparatus main assembly 2.

As described above, before the drawer 51 begins to be moved from its inside position to its outside position, the development cartridge P is changed in its attitude relative to the drawer 51 from the upright one to the tilted one. Thus, even though the image forming apparatus A is structured so that when the drawer 51 is in the inside position, the development cartridge P overlaps with the photosensitive member unit 8 in terms of the direction in which the drawer 51 is moved out of the apparatus main assembly 2, the drawer 51 can be moved to the outside position without raising the drawer 51 to a level at which the development cartridge P does not overlap with the photosensitive member unit 8, or raising the development cartridge P to a level at which the development cartridge P does not overlap with the photosensitive member unit 8. That is, as the development cartridge P is changed in attitude from the upright one to the tilted one, the bottom end of the development cartridge P moves upward by an amount W, as shown in FIG. 11. Therefore, even if the apparatus main assembly 2 is made compact by structuring the apparatus main assembly 2 so that as the development cartridge P is seen from the direction in which the drawer 51 is moved out of the apparatus main assembly 2, the development cartridge P overlaps with the photosensitive member unit 8, the drawer 51 can be moved to its outside position without any contact between the development cartridge P and photosensitive member unit 8. That is, the present invention can contribute to the reduction of the apparatus main assembly 2 in size.

Further, before the drawer 51 begins to be moved outward, the development cartridge P is tilted so that the top end of the development cartridge P shifts in the direction in which the drawer 51 is moved out of the apparatus main assembly 2. As the development cartridge P is tilted in the abovementioned direction, the distance between the highest point of the development cartridge P to the lowest point of the development cartridge P changes from (W+L) to L (FIG. 11). In other words, this structural arrangement can reduce the image forming apparatus A in the amount of the space necessary for the drawer 51 to be moved while the development cartridge P is in the drawer 51, making it possible to further reduce the main assembly 2 of the image forming apparatus A in size.

Further, it is by the movement of the drawer 51 itself that the development cartridge P is changed in attitude. Thus, the image forming apparatus A is not required to have an additional means for changing the development cartridge P in attitude, and also, an operator is not required to carry out an additional operation to change the development cartridge P in attitude. Thus, this embodiment improves the image forming apparatus A in operational efficiency.

Next, the operation for installing the development cartridge P into the apparatus main assembly 2 is described.

FIG. 12 is an enlarged side view of the development cartridge P after the development cartridge P was mounted in the drawer 51, and then, the drawer 51 began to moved into the apparatus main assembly 2. Referring to FIG. 11, the first step for replacing the development cartridge P in the drawer 51 is to move the drawer 51 outward of the apparatus main assembly 2 far enough for the cartridge bay 54 for a specific development cartridge P to be fully exposed from the apparatus main assembly 2. Then, the development cartridge P is to be inserted into the drawer 51 from the direction indicated by an arrow mark J1.

As the drawer 51 is moved outward of the apparatus main assembly 2, the rotation stopper 48*a* is made to move in the direction indicated by the arrow mark H1 by the weight of the development cartridge P itself. Thus, the pressure application spring 44 is compressed by the rotation stopper 48*a*. Consequently, the rotation stopper 48*a* comes under the pressure generated by the spring 44 in the direction indicated by an arrow mark H2. With the presence of this pressure generated by the spring 44, the development cartridge P is suspended between the vertical surface 52*c* of the first groove 52, and the vertical surface 53*c* of the second groove 53. Thus, the development cartridge P remains tilted.

Next, the drawer 51 is moved inward (indicated by arrow mark G2) of the apparatus main assembly 2. During this inward movement of the drawer 51, the development cartridge P remains tilted. Thus, it does not come into contact with the photosensitive member unit 8 while it is moved into the apparatus main assembly 2 by the drawer 51.

After the drawer 51 is moved into its preset inward position in the apparatus main assembly 2, the door 3 (FIGS. 1 and 2) is closed; it is rotationally moved about the shaft 3*a* (hinge).

Referring to FIG. 12, as the door 3 is closed, the movement of the door 3 causes the unshown pressing member, with which the apparatus main assembly 2 is provided, to press on a point of the top portion of the development cartridge P, which is closer to the rotation stopper 48*a* than the center shaft 47*a*. Thus, the development cartridge P is made to rotate about the center shaft 47*a* in the direction indicated by an arrow mark W2 by the pressure applied to the development cartridge P by the unshown pressing member, until the center shaft 47*a* fits into the vertical portion

52*a* of the first groove 52, and the rotation stopper 48*a* fits into the vertical portion 53*a* of the second groove 53. Consequently, the development cartridge P is changed in attitude from the tilted one into the upright one, being allowed to move only in the vertical direction.

Further, as the door 3 is closed, the rails 45 are moved vertically downward (indicated by arrow mark J1) by the movement of the door 3, causing thereby the drawer 51 to move downward with the rails 45. As a result, the development roller 6 is placed in contact with the photosensitive drum 4, and is kept in contact with the photosensitive drum 4 by the pressure from the unshown pressing member. Further, the development roller driving coupling 42*a* of the development cartridge P is connected to the driving force outputting portion of the apparatus main assembly 2, and the voltage receiving portion of the development cartridge P is connected to the voltage (various bias) outputting portion of the apparatus main assembly 2.

This is how the development cartridge P is installed into its preset position in the apparatus main assembly 2, to prepare the image forming apparatus A for an image forming operation.

By the way, in this embodiment, it is the photosensitive member unit 8 that is provided with the guiding member 80*a* which tilts the development cartridge P by coming into contact with the development cartridge P. This embodiment, however, is not intended to limit the present invention in scope in terms of where the guiding member 80*a* is disposed. For example, it may be both the side walls of the apparatus main assembly 2, or a part of the intermediary transfer unit 11, that is provided with the guiding member 80*a*. Further, this embodiment is not intended to limit the present invention in scope in terms of the direction in which the development cartridge P is tilted. That is, the present invention is also applicable to any image forming apparatus as long as the apparatus is structured so that the development cartridge P is tilted to reduce in height the development cartridge passage. That is, not only is the present invention applicable to an image forming apparatus structured so that its development cartridge is tilted in the direction in which the drawer 51 is moved, but also, an image forming apparatus structured so that its development cartridge is tilted in the opposite direction from the direction n which its drawer is moved, or the direction perpendicular to the moving direction of the drawer.

Further, in this embodiment, the image forming apparatus A was designed so that multiple (four) development cartridges are removably mounted in its cartridge drawer (51). However, this embodiment is not intended to limit the present invention in scope in terms of the number of development cartridges to be employed by an image forming apparatus. That is, the present invention is also applicable to an image forming apparatus which employs only one development cartridge, or an image forming apparatus which employs a development cartridge having a developer storing portion, or a photosensitive member cartridge having a photosensitive drum. In a case where the present invention is applied to an image forming apparatus which employs a photosensitive member cartridge having a photosensitive drum, the image forming apparatus is to be structured so that the photosensitive member cartridge is supported by the apparatus main assembly, and is changed in attitude so that its does not overlap with the development unit having a development sleeve, in terms of the direction in which the drawer 51 is moved out of the main assembly.

Further, in this embodiment, the image forming apparatus A was structured so that after the proper installation of the development cartridge P into the apparatus main assembly 2, the development roller 6 was always kept in contact with the photosensitive drum 4 by the unshown pressing member. However, the present invention is also applicable to an image forming apparatus structured so that the development cartridge P is pressed by an unshown pressing member to position the development roller 6 a preset distance away from the photosensitive drum 4. Further, it is applicable to an image forming apparatus which is provided with a mechanism which prevents the pressing member from pressing the development cartridge P while the apparatus is not forming an image, so that while the apparatus is not forming an image, the development roller 6 is kept away from the photosensitive drum 4 by a greater distance than while the apparatus is forming an image.

Moreover, in this embodiment, an electrophotographic photosensitive member was employed as an image bearing member. However, this embodiment is not intended to limit the present invention in scope in terms of the choice of an image bearing member. That is, the present invention is also applicable to an image forming apparatus which employs an electrostatic recording member, or a magnetic recording member, as its image bearing member.

Further, the application of the present invention is not limited to an image forming apparatus of the so-called intermediary transfer type. That is, the present invention is also applicable to an image forming apparatus which forms an image on its image bearing member, of developer, and directly transfers the image onto recording medium. Further, the present invention is also applicable to a monochromatic image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2016-198670 filed on Oct. 7, 2016 and 2017-169920 filed on Sep. 5, 2017, which are hereby incorporated by reference herein in their entirety.

What is claimed is:

1. An image forming apparatus for forming an image, said apparatus comprising:

a main assembly;

a photosensitive member unit supported by said main assembly and including a photosensitive member;

a cartridge including a developer carrying member, a coupling for receiving a driving force for driving said developer carrying member, and an accommodating portion accommodating a developer to be supplied to said photosensitive member; and a supporting member provided inside said main assembly to support said cartridge and movable between an inside position in which said cartridge is mounted to said main assembly, and an outside position outside said main assembly, wherein said supporting member is movable to the outside position independently from said photosensitive member unit, wherein when said supporting member is in the inside position, said photosensitive member and said cartridge are disposed at positions overlapping with each other as seen in a moving direction of said supporting member, and wherein said cartridge is displaced from a first position taken when said supporting member is in the inside position to a second position in which said cartridge does not interfere with said photosensitive member, by said cartridge rotating about a rotation axis of said coupling relative to said supporting member, during movement of said supporting member from the inside position to the outside position independently from said photosensitive member which remains inside said main assembly.

2. An apparatus according to claim 1, further comprising a guiding member contactable to said cartridge to move said cartridge to the second position.

3. An apparatus according to claim 1, wherein said cartridge further includes an annular configuration portion around said coupling, and said cartridge is movable from the first position to the second position by said annular configuration portion rotating while contacting an at-rotation positioning portion.

4. An apparatus according to claim 3, wherein said at-rotation positioning portion is provided on said supporting member.

5. An apparatus according to claim 4, wherein said annular configuration portion is engageable with said supporting member to position said cartridge relative to said supporting member.

6. An apparatus according to claim 1, wherein a distance from a top end portion of said cartridge to a bottom end portion thereof measured in a vertical direction is shorter when said cartridge is in the second position than in the first position.

7. An apparatus according to claim 6, wherein when said cartridges is in the second position, said cartridge is inclined such that a position of a top end portion of said cartridge with respect to a vertical direction is shifted in the moving direction of said supporting member as compared with the position of the top end portion when said cartridge is in the first position.

8. An apparatus according to claim 1, further comprising urging means configured to urge said cartridge relative to said supporting member to hold said cartridge in the second position, when said cartridge is in the second position.

9. An apparatus according to claim 1, wherein said developer carrying member is configured to supply the developer to said photosensitive member from said accommodating portion, wherein said main assembly is provided with an openable member, and wherein said photosensitive member and said developer carrying member are brought into contact with each other in interrelation with a closing operation of said openable member, and said photosensitive member and said developer carrying member are spaced from each other in interrelation with and opening operation of said openable member.

10. An apparatus according to claim 1, wherein said developer carrying member is configured to supply the developer to said photosensitive member from said accommodating portion.

* * * * *